US005305782A

United States Patent [19]

Kipling et al.

[11] Patent Number: 5,305,782

[45] Date of Patent: Apr. 26, 1994

[54] PNEUMATIC CONTROL VALVE SYSTEM

[75] Inventors: Graham V. Kipling, Ajax; Paul H. Martin, Toronto, both of Canada

[73] Assignee: Diesel Equipment Limited, Toronto, Canada

[21] Appl. No.: 7,954

[22] Filed: Jan. 22, 1993

[51] Int. Cl.[5] ..... F15B 13/04

[52] U.S. Cl. ..... 137/596; 60/433; 137/627.5; 137/636; 137/636.1; 298/22 C

[58] Field of Search ..... 60/433; 137/596, 627.5, 137/636, 636.1; 298/22 C

[56] References Cited

U.S. PATENT DOCUMENTS 4,682,621 7/1987 Kipling ..... 137/627.5 X 4,848,404 7/1989 Hickok ..... 137/625.64

*Primary Examiner*—Gerald A. Michalsky

[57] ABSTRACT

A pneumatic control valve system has a modulating valve and a piston. When the operator depresses the piston, pressure is communicated to a switching piston moving that piston to a switched position so that pressure is communicated to a switching outlet. The switching piston retains this switched position when the first piston is released. When the modulating valve is opened to communicate pressure to a work port, pressure is also communicated to the switching piston in order to move the switching piston back to its unswitched position whereat the switching outlet is vented. The switching piston allows the control of another function.

7 Claims, 7 Drawing Sheets

PNEUMATIC CONTROL VALVE SYSTEM

BACKGROUND OF THE INVENTION

1. Field of the Invention

This invention relates to a pneumatic control valve system.

2. Description of the Related Art

A pneumatic control valve system for the control of a hydraulic system, such as a dump truck hoist, is known. For control of a dump truck hoist, one pneumatic valve typically controls the raising of the dump body and a second pneumatic valve controls the lowering of the body. Typically, a lever associated with the valves and may be pivoted in one direction to depress one of the pneumatic valves and in an opposite direction to depress the other pneumatic valve. In controlling a hydraulic system, the pneumatic control valve system must typically provide a further function. For example, with a dump truck hoist, it is necessary to engage the power take-off (referred to as the "PTO") in order to raise the hoist. As is well understood by those skilled in the art, the PTO is a gear in the transmission which must be engaged to run the hydraulic oil pump. In known pneumatic control valve systems, a separate lever or switch is typically employed to engage the PTO. However, the operator must remember to disengage the PTO prior to driving off as, otherwise, the oil pump will be driven at destructive high speeds.

This invention seeks to overcome drawbacks in the known prior art.

SUMMARY OF THE INVENTION

According to the present invention, there is provided a pneumatic control valve system comprising: an actuating chamber having a pressure passageway, a switching passageway, a vent, and a piston between said actuating chamber pressure passageway, said actuating chamber vent, and said actuating chamber switching passageway movable between a first position whereat said actuating chamber pressure passageway is cut off from said actuating chamber switching passageway and is vented and a second position whereat said actuating chamber pressure passageway is not vented and communicates with said actuating chamber switching passageway; means to bias said actuating chamber piston to a position whereat said actuating chamber pressure passageway is cut off from said actuating chamber switching passageway; a work chamber having a pressure passageway, a work passageway, a switching passageway, a vent, and a piston and plunger assembly between said work chamber pressure passageway on the one hand and said work passageway, work chamber switching passageway, and work chamber vent on the other, biasing means biasing said piston and plunger assembly to a first position whereat said work passageway and said work chamber switching passageway are cut off from said work chamber pressure passageway and vented, said piston and plunger assembly moveable to a second position whereat said work passageway and said work chamber switching passageway are not vented and communicate with said work chamber pressure passageway; said work chamber, said piston and plunger assembly, and said work chamber biasing means comprising a modulator valve, said work chamber piston moveable past said second position to a third position for, when said work chamber pressure passageway is pressurized, increasing pressure at said work passageway and said work chamber switching passageway with increasing deflection of said work chamber piston past said second position toward said third position; said work passageway terminating at a work port for connection to a control line; a switching chamber having a pressure passageway, a switching outlet and a switching piston between said switching chamber pressure passageway and said switching outlet, said actuating chamber switching passageway communicating with said switching chamber at one end of said switching piston, said work chamber switching passageway communicating to said switching chamber at another end of said switching piston, said switching piston moveable between an unswitched position whereat said switching chamber pressure passageway is cut off from said switching outlet and a switched position whereat said switching chamber pressure passageway communicates with said switching outlet; means to retain said switching piston in said switched position and in said unswitched position; whereby when each said pressure passageway is pressurised and said actuating chamber piston is moved against said actuating chamber biasing means in order to communicate said actuating chamber pressure passageway with said actuating chamber switching passageway, said switching piston is moved to one of said switched and unswitched positions, said switching piston retaining said one position when said actuating chamber piston returns to a position whereat said actuating chamber pressure passageway is cut off from said actuating chamber switching passageway and whereby when said work chamber piston is deflected past said second position, pressure is communicated through said work passageway to said work port for pressurizing a control line and whereby when said work chamber piston is deflected sufficiently past said second position, pressure communicated from said work chamber pressure passageway to said work chamber switching passageway overcomes said retaining means and acts to move said switching piston to the other of said switched and unswitched positions, said switching piston retaining said other position when said work chamber piston returns to said first position whereat said work chamber pressure passageway is cut off from said work chamber switching passageway.

BRIEF DESCRIPTION OF THE DRAWINGS

In the figures which disclose example embodiments of the invention.

DESCRIPTION OF THE PREFERRED EMBODIMENTS

Figure 1:
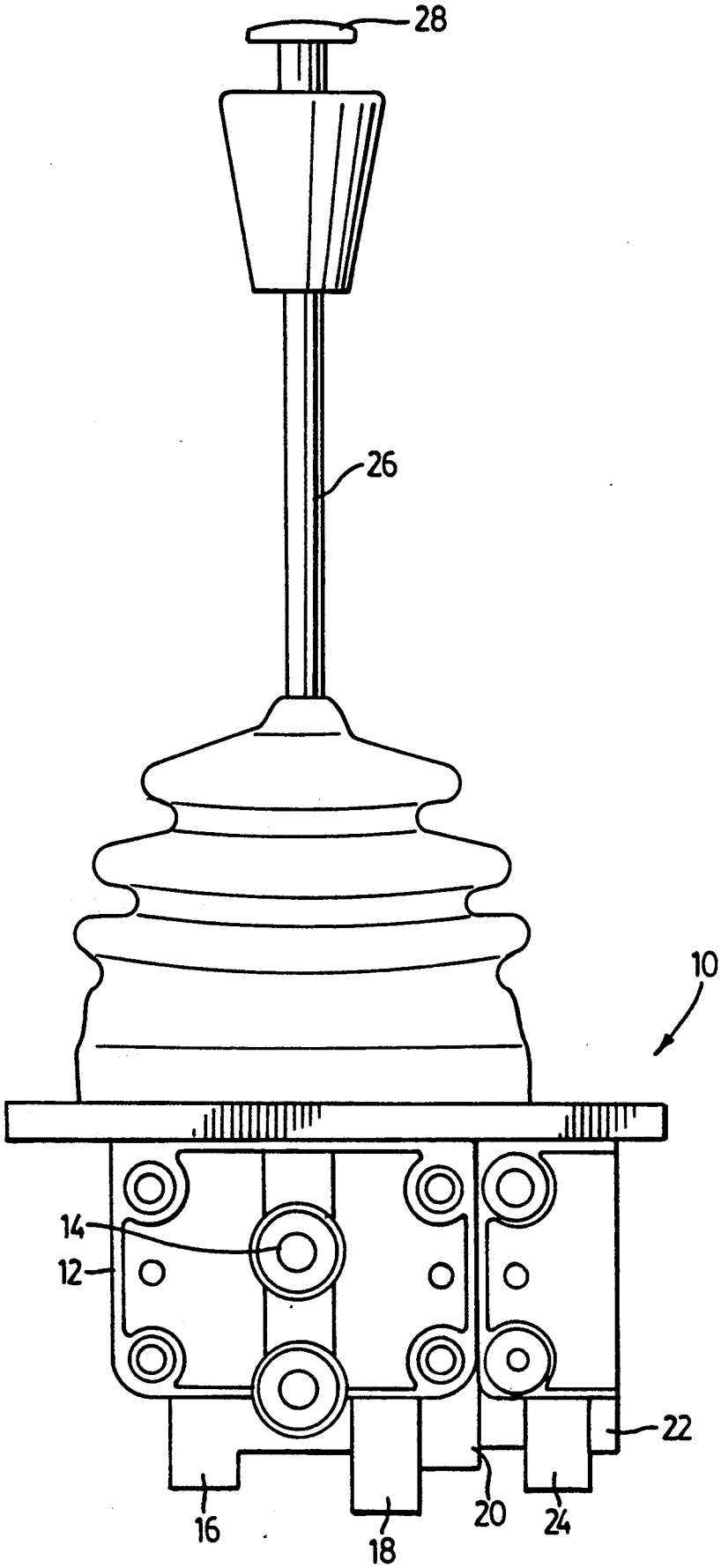
FIG. 1 is a front view of a pneumatic control valve system made in accordance with this invention.
Figure 2:
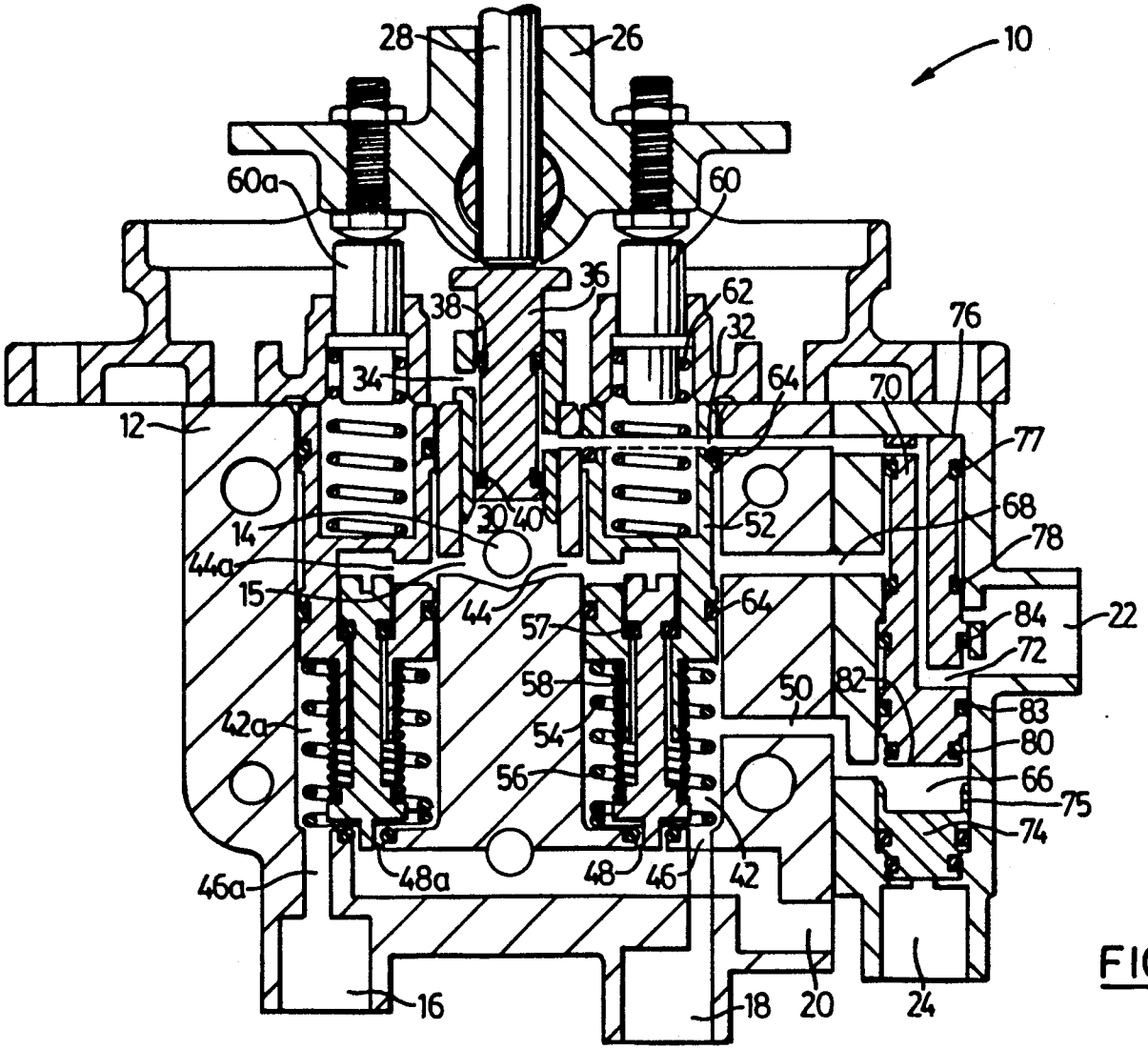
FIG. 2 is a schematic partially cross-sectioned view of a portion of FIG. 1, FIGS. 3 through 6 are simplified partially cross-sectioned views illustrating the operation of the pneumatic control valve system of this invention.

With reference to FIGS. 1 and 2, a pneumatic control valve system 10 comprises a housing 12 with a pressure port 14, work ports 16 and 18, exhaust port 20, switching outlet 22 and control port 24. A lever 26 is pivotally mounted to the housing. The lever incorporates plunger 28.

Turning specifically to FIG. 2, the housing 12 has an actuating chamber 30 therein. A pressure chamber 15 of the actuating chamber communicates with pressure port 14. Pressure passageways 44 and 44a communicate to pressure chamber 15 of the actuating chamber. An actuating chamber switching passageway 32 and a vent 34 also communicate with the actuating chamber. A piston 36 is disposed within the actuating chamber between the pressure passageways 44 and 44a, the switching passage 32, and the vent 34. The piston has O-rings 38 and 40. Plunger 28 terminates at piston 36.

Housing 12 also has a work chamber 42 which opens to pressure passageway 44 and to a pressure passageway 68. Passageway 68 communicates with pressure passageway 44 through the work chamber (around modulating piston 52). The work chamber also has a work passageway 46 which communicates with work port 18, an exhaust passageway 48 which communicates with common exhaust port 20 and a switching passageway 50. Modulating piston 52 is disposed in the work chamber between the pressure passageway 44 on the one hand and the work passageway 46, exhaust passageway 48 and switching passageway 50 on the other. A spring 54 biases the piston 52 to a first position shown in FIG. 2 so that the piston abuts the top of housing 12. Piston 52 has a plunger 56 biased to an extended position by spring 58 so that the plunger seats on seat 57 of the modulating piston. An actuating plunger 60 is biased into abutment with the top of the housing by spring 62 extending from the piston 52. O-rings 64 provide a seal between the piston and the walls of the work chamber. It will be appreciated that the actuating chamber switching passage 32 passes around (and not through) work chamber 42.

As is described in further detail hereinafter, work chamber 42 with its modulating piston 52, plunger 56 and springs 54, 58, and 62 forms a modulator valve.

Pressure passageway 68 communicates to a switching chamber 66 at the side of a switching piston 70 within the switching chamber. The switching passageway 32 communicates to the switching chamber at one end 76 of piston 70 and switching passageway 50 communicates to the switching chamber at the other end 82 of piston 70. A number of O-rings surround piston 70. One of these, O-ring 77, surrounds the piston 70 proximate end 76 of the piston; another, O-ring 80, surrounds the piston 70 at the end 82 of the piston. Switching chamber 66 also has control port 24 and switching outlet 22. The piston 70 is disposed within the switching chamber between the pressure passageway 68 and the switching outlet 22. O-ring 78 surrounds the piston between the pressure passageway 68 and the switching outlet 22. A venting passageway 72 extends through the piston from the end 76 of the piston to the side of the piston in the vicinity of switching outlet 22. An O-ring 83 surrounds the piston just below the opening of the vent which is in the vicinity of the switching outlet and a further O-ring 84 surrounds the piston just above the opening of the vent which is in the vicinity of the switching outlet. A control piston 74 is disposed within the switching chamber between control port 24 and end 82 of piston 70. The control piston has a flange 75 which when the switching piston is in the position illustrated in FIG. 3, seals with O-ring 80.

A second work chamber 42a has a pressure passageway 44a communicating with pressure chamber 15 and, therefore, with pressure port 14, a work passageway 46a communicating with work port 16, and an exhaust passageway 48a communicating with common exhaust port 20. An actuating plunger 60a extends into the work chamber 42a. Internally, work chamber 42a is identical to work chamber 42 and is therefore not further detailed except to note that work chamber 42a therefore also contains a modulator valve.

The lever 26 is pivoted to housing 12 so that tilting the lever in one direction depresses actuating plunger 60 and tilting the lever in the opposite direction depresses actuating plunger 60a.

The described pneumatic control valve system may be employed in the control of a dump truck hoist as follows. Pressure port 14 is connected into the pneumatic pressure line of the dump truck. Work port 16 is connected to the control for the hydraulic cylinder of the hoist such that pressure communicated through work port 16 causes the hydraulic cylinder to extend, which raises the hoist. Work port 18 is connected to the control for the hydraulic cylinder which allows the cylinder to retract. Vent 34 and common exhaust port 20 are vented to atmosphere. Control port 24 is connected to the air pressure line from the parking brake which is pressurized to release that brake. Switching outlet 22 is connected to the control for the PTO.

The operation of the valve system in the control of a dump truck hoist is now described in connection with FIGS. 2 through 6. With the system 10 in the configuration of FIG. 2, it will be noted that vent 34 is in communication with switching passageway 32 around piston 36. The switching passageway 32 communicates to vent 72 which in turn communicates to switching outlet 22. Consequently, switching outlet 22 is at ambient pressure. It is assumed that while the switching outlet is at ambient pressure, the PTO is biased to an inoperative position such that the oil pump for the hydraulic cylinder of the hoist is inoperative. Accordingly, the hoist may not be raised while the control system 10 is in a configuration of FIG. 2. A number of the O-rings surrounding the piston 70 frictionally engage the wall of the switching chamber to retain the piston in position.

Figure 3:
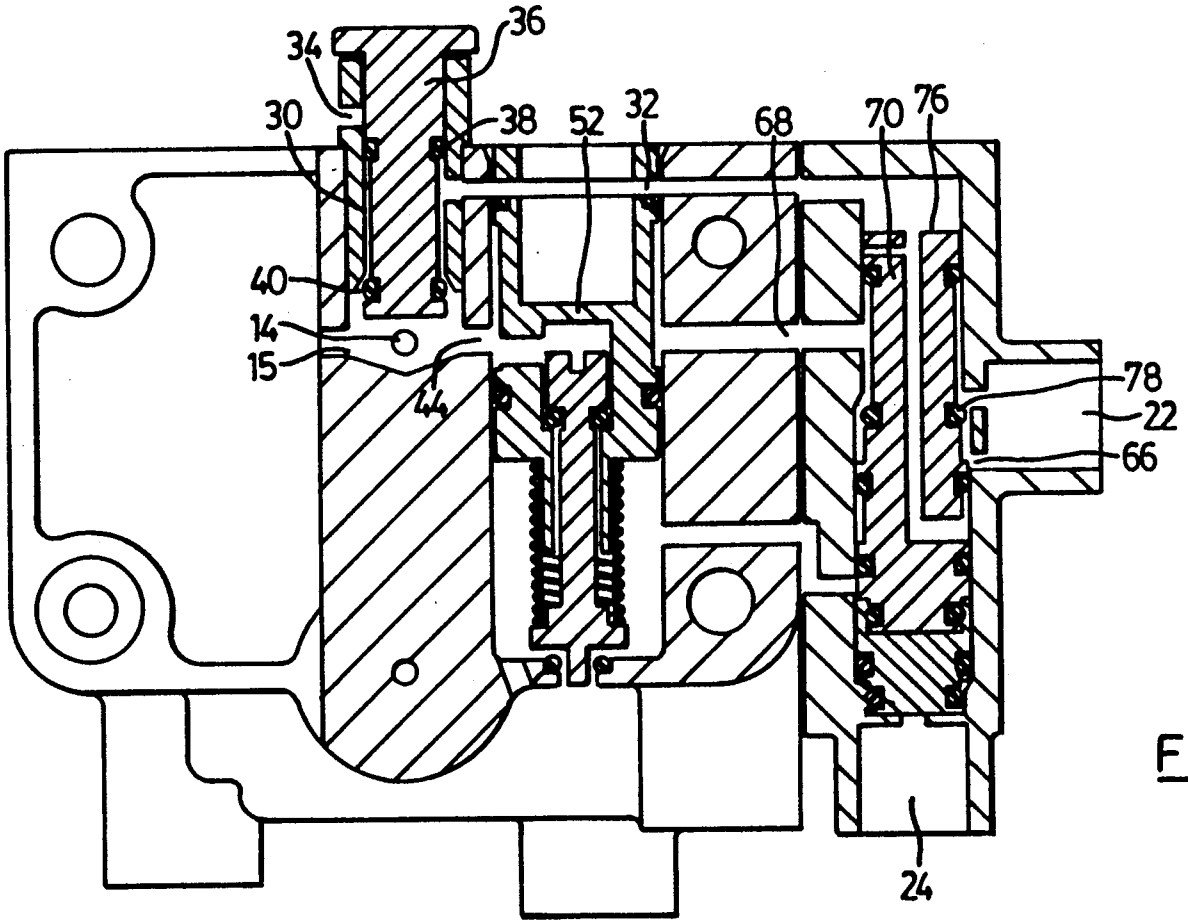

As shown in FIG. 3, if the operator then depresses plunger 36, O-ring 38 of piston 36 is interposed between switching passageway 32 and vent 34 which cuts the switching passageway off from vent 34. Simultaneously, the lower O-ring 40 of piston 36 is unseated from the wall of the actuating chamber 30 which communicates pressure port 14 with switching passageway 32. Consequently, high pressure is applied to the one end 76 of piston 70. This causes the piston to move from its unswitched position shown if FIG. 2 to its switched position shown in FIG. 3. With the piston 76 in the switched position of FIG. 3, O-ring 78 is unseated from the wall of the switching chamber such that pressure within pressure passageway 68 communicates around switching piston 70 to switching outlet 22 (and it will be noted pressure passageway 68 is in communication with pressure port 14). The pressure communicating to switching outlet 22 causes the PTO to engage such that the oil pump for the hydraulic cylinder of the hoist begins pumping.

Figure 4:
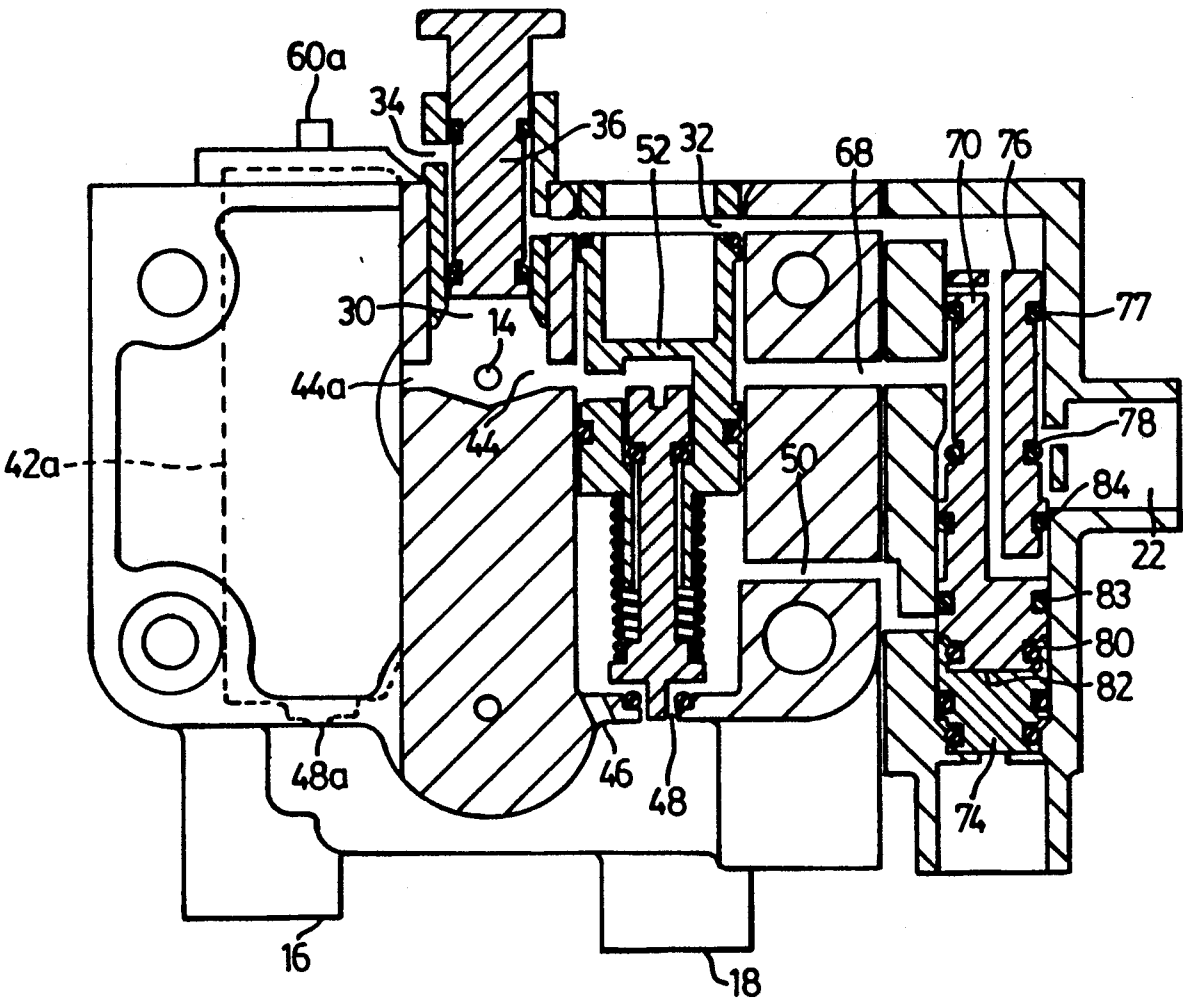

As shown in FIG. 4, when the operator releases piston 36, it returns to its undepressed position in view of the pressure communicating to the base of the piston through pressure chamber 15. When the piston returns to its undepressed position, switching passageway 32, and therefore the top 76 of piston 70, again communicates to atmosphere through vent 34. However, there is nothing to motivate switching piston 70 to move and, therefore, it remains in its switched position as illustrated in FIG. 4. Indeed, the O-rings around the piston continue to provide a retaining force. More importantly, the pressure communicated through passageway 68 is communicated to piston 70 between O-rings 77 and 84. This, coupled with the fact that the area of the piston below O-ring 77 is smaller than the area of the piston above O-ring 84 when the switching piston is in its switched position, results in an effective area of the piston 70 above O-ring 84 which is acted on by the pressure from passageway 68. This means that a downward force is applied to the piston 70 to maintain the switching piston in the switched position. And with the switching piston retained in the switched position, pressure continues to be communicated from pressure port 14 through passageways 44 and 68 to the switching outlet 22. Therefore the oil pump of the hydraulic system remains operative.

Figure 5:
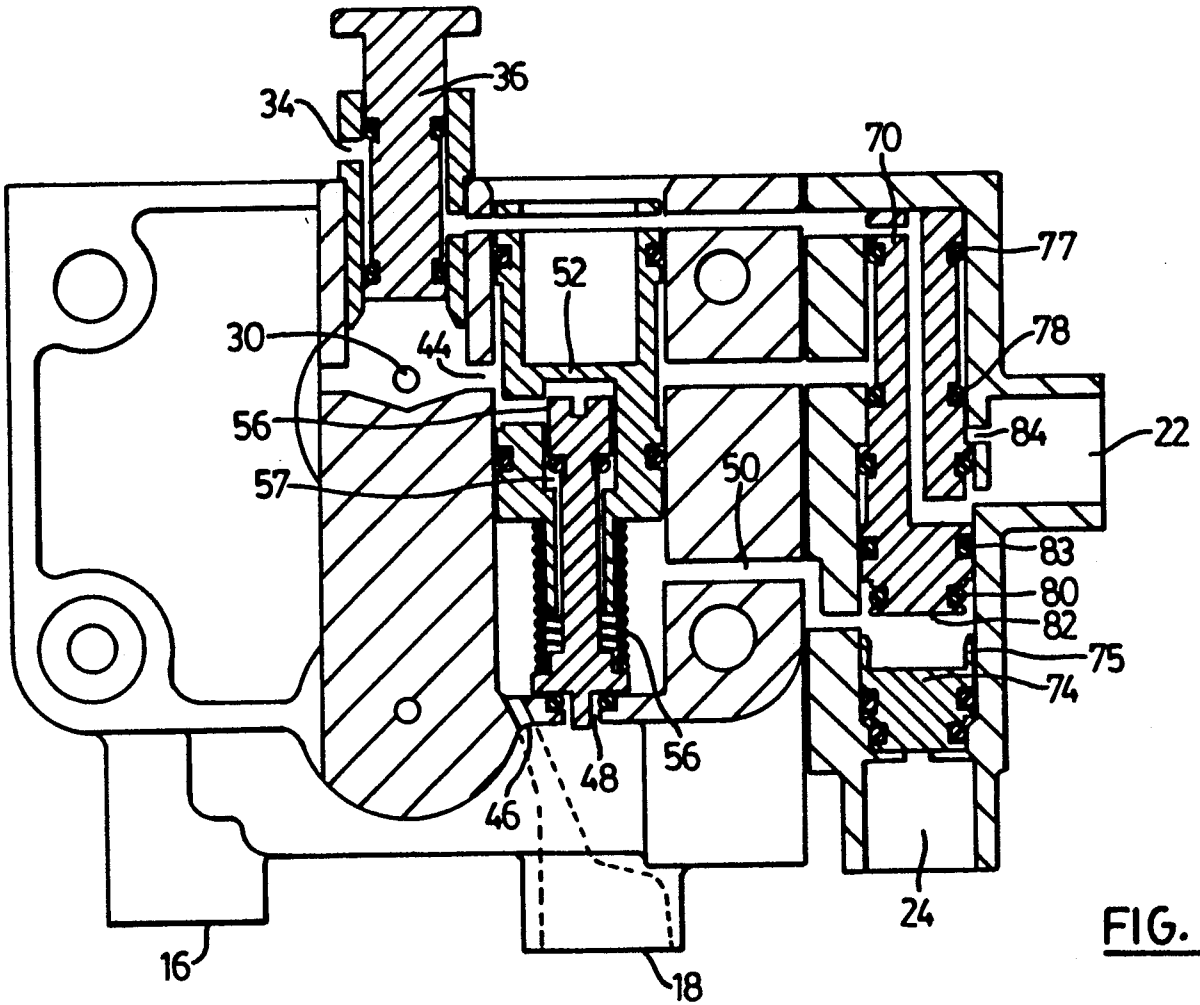

In the position for the valve system shown in FIG. 4, the operator may depress the actuating plunger 60*a* (by tilting lever 26 of FIG. 2) in order to move the piston within work chamber 42*a* so that the exhaust 48*a* is blocked off by the plunger of the piston and the plunger temporarily unseats from the piston. This will have the effect of communicating pressure from pressure passageway 44*a* to work port 16. As is explained valve, the greater the degree that actuating plunger 60*a* is depressed, the greater the pressure communicated to work port 16. The pressure at work port 16 controls the rate at which the hydraulic cylinder of the hoist extends to raise the dump truck body. Alternatively, the operator may depress actuating plunger 60 (by tilting the lever 26 of FIG. 2 in the opposite direction) so that, as shown in FIG. 5, plunger 56 moves to block exhaust 48 and lifts off from its seat 57 on the modulating piston 52 in order to communicate pressure passageway 44 to work passageway 46 and hence work port 18. This communicates pressure to the work passageway 46 and as the pressure increases this tends to urge piston 52 upwardly against the force of spring 62 (seen in FIG. 2) in order to reseat the plunger within the piston to shut off pressure passageway 46 (and switching passageway 50) from pressure passageway 44. In this way, as will be understood by those skilled in the art, the pressure which is communicated to the work port may be modulated. The operation of such a modulator valve is also detailed in U.S. Pat. No. 4,682,621 to Kipling, the disclosure of which is incorporated by reference. The pressure in work port 18 controls the rate at which the hydraulic cylinder may retract under the force of gravity. Accordingly, the pressure in work port 18 controls the rate of descent of the dump truck body.

When pressure is communicated to work passageway 46, it is also communicated to switching passageway 50. With the switching piston in the switched position (seen, for example, in FIG. 4), pressure communicated to passageway 50 is communicated from the passageway to the portion of the bottom end 82 of piston 70 exteriorly of O-ring 83. The pressure around this annulus produces a force on piston 70 urging it toward the unswitched position. On the other hand, as aforenoted, pressure continues to be communicated through passageway 68 to piston 70 between O-rings 77 and 84 such that there is an effective area of piston 70 above O-ring 84 opposite the annulus at end 82 of the piston. This effective area is smaller than the annulus at end 82 of the piston but the pressure applied to this effective area results in an opposing downward force on piston 70 which is nevertheless greater than the upward force on the piston for lower pressures communicated to switching passageway 50. Consequently, for lower pressures, switching piston 70 does not move from its switched position. In the result, the dump truck body may be lowered at a slow rate, equated with a relatively low pressure at work port 8 (and hence switching passageway 50) without moving switching piston 70 and, therefore, without disengaging the PTO.

If modulating piston 52 is depressed sufficiently, the pressure communicated through to the bottom of the switching piston 70 will be sufficient such that the resulting force will exceed the opposing force applied to the switching piston above -ring 84 and will cause the switching piston to begin to move toward its unswitched position. As soon as O-ring 80 clears flange 75 of control piston 74, the pressure from the switching passageway 50 is communicated across the entirety of the bottom 2 of the switching piston 70. This greatly increases the force on the piston 70 and causes it to snap to its unswitched position, as shown in FIG. 5. The reason for snapping the piston back to the unswitched position is that it avoids the possibility of the operator releasing the work chamber piston 52 and thereby opening the exhaust passageway 48 before the switching piston 70 has completed its move to the unswitched position. Snapping the switching piston back also quickly moves the O-rings of the switching piston past the various openings to the switching chamber so that they are not damaged by this passage. Once the switching piston 70 returns to its unswitched position, the switching outlet 22 is again vented. This results in the PTO disengaging so that the oil pump for the hydraulic system stops. Despite this, the dump truck hoist may still be lowered under control of the pressure communicated to work port 18 (due to the degree of depression of the actuating plunger 60), however, the dump truck body may not be raised again because the PTO is disengaged.

With the pneumatic valve control system of this invention, a dump truck operator may engage the PTO, raise the dump truck body to begin dumping his load and then lower the dump truck body to cease dumping without disengaging the PTO, so long as the rate of lowering does not exceed a certain maximum. Therefore, a part load may be dumped initially without disengaging the PTO, and subsequently the dump truck body may be again raised to dump the remainder of the load. Also, when the dump truck body is lowered at a faster rate than the certain maximum (such as when dumping is completed and the operator simply wants to return the dump truck body to its lowered position) the PTO is automatically disengaged so that the operator may drive off without worry of damaging the oil pump for the hydraulic system.

Figure 6:
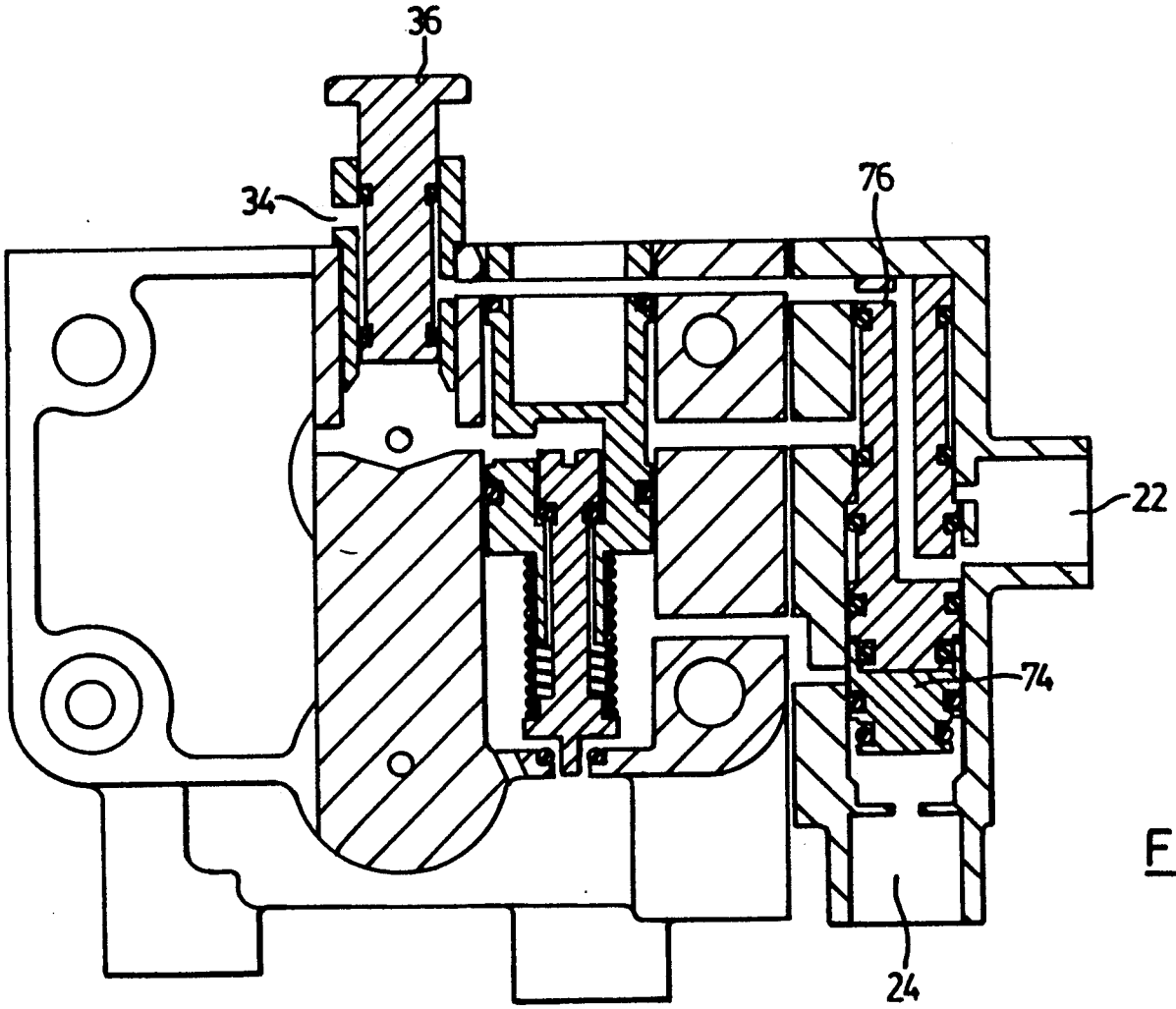

If the operator per chance lowered the dump truck body all of the way at a slow rate, it may be that the PTO remained engaged. This would raise the prospect of the operator driving off with the PTO engaged. However, as soon as the operator releases the parking brake, port 24 is pressurized. As seen in FIG. 6, pressure in control port 24 raises control piston 74, which, in turn, raises switching piston 76 to its unswitched position. In the unswitched position, switching outlet 22 is vented so that the PTO is disengaged. When the operator next depresses piston 36 to engage the PTO, control piston 74 will be forced to its lower position shown in FIG. 3 by switching piston 76 moving to its switched position.

Figure 7:
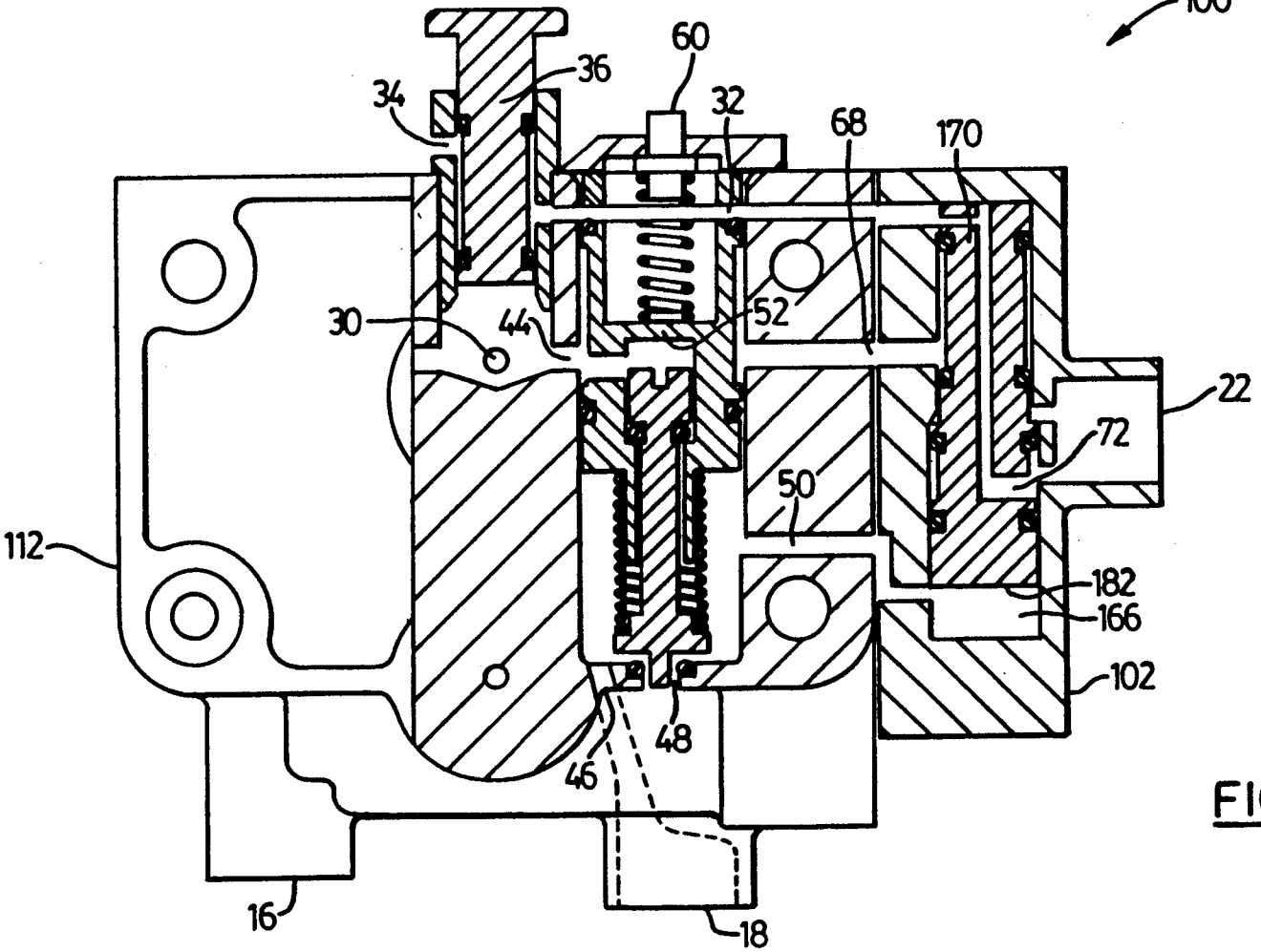
FIG. 7 is a simplified partially cross-sectioned view of another embodiment of a pneumatic control valve system made in accordance with this invention.

FIG. 7 illustrates an alternative embodiment for this invention. With reference to FIG. 7, wherein like parts have been given like reference numerals, a pneumatic control valve system 100 omits a control port, a control piston, and an O-ring at the end of the switching piston in the switching chamber 166. Instead, housing 112 extends below the bottom 182 of this piston 170 at 102. Accordingly, as soon as any pressure is communicated to switching passageway 50, this pressure is applied across the entire surface of end 182 of the switching piston 170. Therefore, even a small depression of the actuating plunger 60 will result in the switching piston 170 returning to its unswitched position illustrated in FIG. 7.

The pneumatic control valve system 100 of FIG. 7 may be used with a hydraulic control system for a snow plow, as follows. A snow plow typically has a double acting hydraulic cylinder which may forcibly lower the plow and which may raise the plow. Also, typically, oil may be ported to both sides of the double acting cylinder so that the plow floats. Work port 16 of the pneumatic control valve system 100 is connected to the control for forcibly lowering the snow plow. Work port 18 is connected to the control for raising the snow plow. Switching outlet 22 is connected to the control for porting oil to both sides of the cylinder in order to allow the plow to float. This control is set up so that when switching outlet 22 is at ambient pressure, oil is not ported from one side of the double acting hydraulic cylinder to the other.

With the described set-up, an operator may press piston 36 in order to move the switching piston 170 to its switched position (whereat it abuts the lower portion 102 of the housing 112). This pressurizes the switching outlet 22 and, hence, ports oil to both sides of the double acting hydraulic cylinder causing the snow plow to float. If the operator later wished to raise the snow plow, actuating plunger 60 may be depressed. This will communicate pressure to work passageway 46 and switching passageway 50. This pressure within passageway 50 will immediately move the piston 170 to its unswitched position shown in FIG. 7 whereby switching outlet 22 will be vented so that oil is no longer ported to both sides of the double acting hydraulic cylinder which permits the plow to be raised under control of the pressure from work port 18.

While the configuration for the pneumatic control valve system of this invention has been described such that depressing piston 36 moves the switching piston to its switched position, it will be understood that the configuration could be modified such that depressing piston 36 would move the switching piston to its unswitched position.

Other modifications will be apparent to those skilled in the art and, therefore, the invention is defined in the claims.

What is claimed is:

1. A pneumatic control valve system comprising:

an actuating chamber having a pressure passageway, a switching passageway, a vent, and a piston between said actuating chamber pressure passageway, said actuating chamber vent, and said actuating chamber switching passageway moveable between a first position whereat said actuating chamber pressure passageway is cut off from said actuating chamber switching passageway and is vented and a second position whereat said actuating chamber pressure passageway is not vented and communicates with said actuating chamber switching passageway;

means to bias said actuating chamber piston to a position whereat said actuating chamber pressure passageway is cut off from said actuating chamber switching passageway;

a work chamber having a pressure passageway, a work passageway, a switching passageway, a vent, and a piston and plunger assembly between said work chamber pressure passageway on the one hand and said work passageway, work chamber switching passageway, and work chamber vent on the other, biasing means biasing said piston and plunger assembly to a first position whereat said work passageway and said work chamber switching passageway are cut off from said work chamber pressure passageway and vented, said piston and plunger assembly moveable to a second position whereat said work passageway and said work chamber switching passageway are not vented and communicate with said work chamber pressure passageway;

said work chamber, said piston and plunger assembly, and said work chamber biasing means comprising a modulator valve, said work chamber piston moveable past said second position to a third position for, when said work chamber pressure passageway is pressurized, increasing pressure at said work passageway and said work chamber switching passageway with increasing deflection of said work chamber piston past said second position toward said third position;

said work passageway terminating at a work port for connection to a control line;

a switching chamber having a pressure passageway, a switching outlet and a switching piston between said switching chamber pressure passageway and said switching outlet, said actuating chamber switching passageway communicating with said switching chamber at one end of said switching piston, said work chamber switching passageway communicating to said switching chamber at another end of said switching piston, said switching piston moveable between an unswitched position whereat said switching chamber pressure passageway is cut off from said switching outlet and a switched position whereat said switching chamber pressure passageway communicates with said switching outlet;

means to retain said switching piston in said switched position and in said unswitched position;

whereby when each said pressure passageway is pressurised and said actuating chamber piston is moved against said actuating chamber biasing means in order to communicate said actuating chamber pressure passageway with said actuating chamber switching passageway, said switching piston is moved to one of said switched and unswitched pistons, said switching piston retaining said one position when said actuating chamber piston returns to a position whereat said actuating chamber pressure passageway is cut off from said actuating chamber switching passageway and whereby when said work chamber piston is deflected past said second position, pressure is communicated through said work passageway to said work port for pressurizing a control line and whereby when said work chamber piston is deflected sufficiently past said second position, pressure communicated from said work chamber pressure passageway to said work chamber switching passageway overcomes said retaining means and acts to move said switching piston to the other of said switched and unswitched positions, said switching piston retaining said other position when said work chamber piston returns to said first position whereat said work chamber pressure passageway is cut off from said work chamber switching passageway.

2. The valve of claim 1 wherein pressurization of said work chamber switching passageway acts to move said switching piston to said unswitched position and wherein said retaining means comprises means to communicate said switching chamber pressure passageway to a small area of said switching piston, at least when said switching piston is in said switched position, so as to impart a retaining force to said switching position acting to retain said switching piston in said switched position.

3. The valve of claim 2 including means to expose only a portion of said another end of said switching piston to any pressure communicated by said work chamber switching passageway to said another end of said switching piston while said piston is in said switched position and to expose the entirety of said another end of said switching position to any pressure communicated by said work chamber switching passageway to said another end of said switching piston while said switching piston is in said unswitched position.

4. The valve of claim 3 wherein said switching chamber includes a control piston between an end of said switching chamber and said another end of said switching piston and further includes a control passageway, said control passageway communicating to the end of said control piston which is distal from said another end of said switching piston.

5. The valve of claim 3 wherein pressurization of said work chamber switching passageway is for moving said switching piston to said unswitched position and wherein said switching piston has a venting passageway communicating with said actuating chamber switching passageway and, when said switching piston is in said unswitched position, with said switching outlet.

6. The valve of claim 2 wherein said retaining means includes friction means associated with said switching piston to provide a frictional force which tends to retain said switching piston in any given position.

7. The valve of claim 1 wherein pressurization of said work chamber switching passageway is for moving said switching piston to said unswitched position and wherein said switching piston has a venting passageway communicating with said actuating chamber switching passageway and, when said switching piston is in said unswitched position, with said switching outlet.

* * * * *

UNITED STATES PATENT AND TRADEMARK OFFICE

CERTIFICATE OF CORRECTION

PATENT NO. : 5,305,782
DATED : April 26, 1994
INVENTOR(S) : Graham V. Kipling; Paul H. Martin It is certified that error appears in the above–identified patent and that said Letters Patent is hereby corrected as shown below:

column 8, line 61, delete "pistons" and insert --positions-- column 9, line 23, delete "position" and insert --piston-- column 10, line 1, delete "position" and insert --piston--

Signed and Sealed this

Sixth Day of September, 1994

Bruce Lehman

*Attest:*

BRUCE LEHMAN

*Attesting Officer*

*Commissioner of Patents and Trademarks*